US009447358B2

(12) United States Patent
Shimizu et al.

(10) Patent No.: US 9,447,358 B2
(45) Date of Patent: Sep. 20, 2016

(54) LUBRICANT COMPOSITION FOR INTERNAL COMBUSTION ENGINE OIL

(71) Applicant: IDEMITSU KOSAN CO., LTD., Chiyoda-ku (JP)

(72) Inventors: Yasunori Shimizu, Ichihara (JP); Junya Iwasaki, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/385,572

(22) PCT Filed: Mar. 19, 2013

(86) PCT No.: PCT/JP2013/057894

§ 371 (c)(1),
(2) Date: Sep. 16, 2014

(87) PCT Pub. No.: WO2013/141258

PCT Pub. Date: Sep. 26, 2013

(65) Prior Publication Data

US 2015/0057200 A1 Feb. 26, 2015

(30) Foreign Application Priority Data

Mar. 21, 2012 (JP) ..... 2012-064095
Mar. 21, 2012 (JP) ..... 2012-064097
Mar. 21, 2012 (JP) ..... 2012-064098

(51) Int. Cl.
*C10M 141/00* (2006.01)
*C10M 141/08* (2006.01)
*C10M 141/12* (2006.01)

(52) U.S. Cl.
CPC ..... *C10M 141/08* (2013.01); *C10M 141/12* (2013.01); *C10M 2203/1025* (2013.01); *C10M 2205/02* (2013.01); *C10M 2207/028* (2013.01); *C10M 2209/086* (2013.01); *C10M 2215/042* (2013.01); *C10M 2215/221* (2013.01); *C10M 2215/223* (2013.01); *C10M 2215/28* (2013.01); *C10M 2219/102* (2013.01); *C10M 2219/104* (2013.01); *C10M 2219/106* (2013.01); *C10M 2223/045* (2013.01); *C10M 2229/02* (2013.01); *C10N 2230/04* (2013.01); *C10N 2230/06* (2013.01); *C10N 2230/08* (2013.01); *C10N 2230/42* (2013.01); *C10N 2230/45* (2013.01); *C10N 2240/10* (2013.01)

(58) Field of Classification Search
CPC ..... C10M 141/08; C10M 141/12
See application file for complete search history.

(56) References Cited

U.S. PATENT DOCUMENTS

| | | | | |
|---|---|---|---|---|
| 3,935,267 | A | 1/1976 | Hauck et al. | |
| 5,106,975 | A | 4/1992 | Malfer et al. | |
| 8,153,565 | B2 * | 4/2012 | Tipton | C10M 141/10 508/192 |
| 2006/0276350 | A1 | 12/2006 | Habeeb et al. | |
| 2013/0005624 | A1 | 1/2013 | Kamano et al. | |

FOREIGN PATENT DOCUMENTS

| | | | |
|---|---|---|---|
| EP | 0 713 908 | A1 | 5/1996 |
| EP | 1 239 021 | A2 | 9/2002 |
| JP | 51-125054 | | 11/1976 |
| JP | 3-161479 | | 7/1991 |
| JP | 7-316576 | | 12/1995 |
| JP | 10-505107 | | 5/1998 |
| JP | 2005-263830 | | 9/2005 |
| JP | 2008-542504 | | 11/2008 |
| WO | WO 95/10584 | A1 | 4/1995 |
| WO | WO 03/042341 | A2 | 5/2003 |
| WO | WO 2011/111795 | | 9/2011 |

OTHER PUBLICATIONS

U.S. Appl. No. 14/385,874, filed Sep. 17, 2014, Iwasaki, et al.
International Search Report issued Jun. 18, 2013, in PCT/JP13/057894 filed Mar. 19, 2013.
Extended European Search Report issued Oct. 20, 2015 in Patent Application No. 13763683.3.
Office Action issued Jul. 19, 2016 in Chinese Patent Application No. 201380014987.6.

* cited by examiner

*Primary Examiner* — Cephia D Toomer
(74) *Attorney, Agent, or Firm* — Oblon, McClelland, Maier & Neustadt, L.L.P.

(57) ABSTRACT

The present disclosure relates to a lubricating oil composition containing a base oil, a thioheterocyclic compound represented by the formula:

$$(R^1)_k—(S)_m—As—(S)_n—(R^2)_l,$$

and an aminoalcohol compound containing, in the molecule thereof, a piperazine moiety and one or more hydroxyl groups. The lubricating oil composition has a phosphorus content (P mass %) and a sulfated ash content (M mass %), based on a total mass of the lubricating oil composition, satisfying any of the following conditions A to C:

condition A: $P<0.03$, and $M<0.3$;
condition B: $P<0.03$, and $0.3\leq M\leq 0.6$; and
condition C: $0.03\leq P\leq 0.06$, and $M<0.3$.

8 Claims, No Drawings

LUBRICANT COMPOSITION FOR INTERNAL COMBUSTION ENGINE OIL

CROSS-REFERENCE TO RELATED APPLICATIONS

This application is a National Stage of PCT/JP2013/057894 filed on Mar. 19, 2013, This application is based upon and claims the benefit of priority to Japanese Application No. 2012-064095 filed on Mar. 21, 2012, and to Japanese Application No. 2012-064097 filed on Mar. 21, 2012 and to Japanese Application No. 2012-064098 filed on Mar. 1, 2012.

TECHNICAL FIELD

The present invention relates to a lubricating oil composition for internal combustion engines.

BACKGROUND ART

In recent years, for the purpose of reducing environmental loads, strict regulations against exhaust gases have been successively introduced in the automotive industry. The exhaust gases contain, in addition to carbon dioxide ($CO_2$) as a global warming substance, various harmful substances such as particular matters (PM), hydrocarbons (HC), carbon monoxide (CO) and nitrogen oxides ($NO_x$). Among these substances, very strict regulation values have been imposed on PM and $NO_x$. As the measure for reducing an amount of these substances discharged, gasoline automobiles are provided with a three-way catalyst, whereas diesel automobiles are provided with a diesel particulate filter (DPF). The exhaust gases are cleaned by passing through these members, and then discharged into atmospheric air.

In recent years, it has recently reported that the active sites of the three-way catalyst tend to be poisoned with phosphorus components in engine oils to thereby cause deterioration in a catalyst performance thereof, and that ash derived from metal components is deposited on the DPF to thereby reduce the service life of the DPF. At present, in the ILSAC Standard and the JASO Standard as standards for engine oils, the upper limits of the phosphorus content and ash content in engine oils have been established, and the engine oils having lower contents of these substances have now been developed.

There has been proposed addition of an aminoalcohol-based compound to a lubricating oil as an ashless detergent-dispersant (Patent Document 1).

However, since the aminoalcohol-based compound additive for lubricating oil disclosed in Patent Document 1 has unsatisfactory detergency at high temperature, an additional metallic detergent must be used. When such a metallic detergent is used so as to enhance high-temperature detergency, filter structures of exhaust gas cleaning apparatuses; e.g., a particulate trap and an oxidation catalyst for oxidizing unburnt fuel and lubricating oil, tend to be clogged (plugged) with deposits (metallic and other deposits), thereby problematically impairing characteristics of internal combustion engines.

PRIOR ART DOCUMENTS

Patent Documents

Patent Document 1: JP 7-316576A

SUMMARY OF THE INVENTION

Problems to be Solved by the Invention

An object of the present invention is to provide a lubricating oil composition for internal combustion engines that can maintain detergency at high temperature, as well as wear resistance, even when amounts of a phosphorus-containing additive and a metallic detergent are considerably reduced.

Means for Solving the Problems

The present inventors have carried out extensive studies, and have found that the object can be attained by incorporating a thioheterocyclic compound and an aminoalcohol compound into a lubricating oil composition. The present invention has been accomplished on the basis of this finding.

Accordingly, the present invention provides a lubricating oil composition for internal combustion engines comprising a base oil, a thioheterocyclic compound represented by the following formula (I):

$$(R^1)_k—(S)_m\text{-}A_S\text{-}(S)_n—(R^2)_l \quad (I)$$

(wherein As represents a thioheterocycle; each of $R^1$ and $R^2$ represents a hydrogen atom, an amino group, a C1 to C50 hydrocarbyl group selected from among an alkyl group, a cycloalkyl group, an alkenyl group, a cycloalkenyl group, and an aryl group, or, in the case of a hydrocarbyl group, a C1 to C50 heteroatom-containing group having an atom selected from among an oxygen atom, a nitrogen atom, and a sulfur atom, in the hydrocarbyl group; and each of k, l, m, and n is an integer of 0 to 5), and an aminoalcohol compound having, in the molecule thereof, one or more amino groups and one or more hydroxyl groups, wherein the composition has a phosphorus content (P mass %) and a sulfated ash content (M mass %), based on the total amount of the composition, satisfying any of the following conditions A to C:

condition A: $P<0.03$, and $M<0.3$;

condition B: $P<0.03$, and $0.3\leq M\leq 0.6$; and condition C: $0.03\leq P\leq 0.06$, and $M<0.3$.

Effects of the Invention

The present invention enables to provide a lubricating oil composition for internal combustion engines composition that can maintain detergency at high temperature and wear resistance, even when amounts of a phosphorus-containing additive and a metallic detergent are considerably reduced.

MODES FOR CARRYING OUT THE INVENTION

[Lubricating Oil Composition for Internal Combustion Engines]

The lubricating oil composition for internal combustion engines according to the present invention (hereinafter may be referred to simply as a "lubricating oil composition) contains a base oil, a thioheterocyclic compound represented by the following formula (I):

$$(R^1)_k—(S)_m\text{-}A_S\text{-}(S)_n—(R^2)_l \quad (I)$$

(wherein As represents a thioheterocycle; each of $R^1$ and $R^2$ represents a hydrogen atom, an amino group, a C1 to C50 hydrocarbyl group selected from among an alkyl group, a cycloalkyl group, an alkenyl group, a cycloalkenyl group, and an aryl group, or, in the case of a hydrocarbyl group, a C1 to C50 heteroatom-containing group having an atom selected from among an oxygen atom, a nitrogen atom, and a sulfur atom, in the hydrocarbyl group; and each of k, l, m, and n is an integer of 0 to 5), and an aminoalcohol compound having, in the molecule thereof, one or more amino groups and one or more hydroxyl groups, wherein the composition has a phosphorus content (P mass %) and a sulfated ash content (M mass %), based on the total amount of the composition, satisfying any of the following conditions A to C:

condition A: $P<0.03$, and $M<0.3$;

condition B: $P<0.03$, and $0.3\leq M\leq 0.6$; and condition C: $0.03\leq P\leq 0.06$, and $M<0.3$.

The aforementioned elements will next be described in detail.

[Base Oil]

No particular limitation is imposed on the base oil employed in the present invention, and any of the conventionally used lube oil base oils including mineral oil and synthetic oil may be appropriately selected.

Examples of the mineral oil include a mineral oil produced through subjecting a lube oil fraction which has been obtained through distillation of crude oil at ambient pressure and distillation of the residue under reduced pressure, to at least one treatment selected from among solvent deasphalting, solvent extraction, hydro-cracking, solvent dewaxing, catalytic dewaxing, and hydro-refining. Another example is a mineral produced through isomerization of wax or isomerization of GTL wax.

Examples of the synthetic oil include polybutene, polyolefins [α-olefin homopolymer and copolymers (e.g., ethylene-α-olefin copolymer)], esters (e.g., polyol ester, dibasic acid ester, and phosphate ester), ethers (e.g., polyphenyl ether), polyglycols, alkylbenzenes, and alkylnaphthalenes. Among these synthetic oils, polyolefins and polyol ester are preferred.

In the present invention, the aforementioned mineral oils may be used singly, or in combinations of two or more species, as base oil. Also, the aforementioned synthetic oils may be used singly, or in combinations of two or more species. Alternatively, one or more members of the mineral oils and one or more members of the synthetic oils may be used in combination.

No particular limitation is imposed on the viscosity of the base oil, but the kinematic viscosity, as measured at 100° C., is preferably 1.5 $mm^2/s$ to 30 $mm^2/s$, more preferably 3 $mm^2/s$ to 30 $mm^2/s$, still more preferably 3 $mm^2/s$ to 15 $mm^2/s$.

When the kinematic viscosity, as measured at 100° C., is 1.5 $mm^2/s$ or higher, vaporization loss is suppressed, whereas when the kinematic viscosity is 30 $mm^2/s$ or lower, power loss attributable to viscous resistance is suppressed, to thereby improve fuel consumption.

The base oil which is preferably used in the invention has a % CA obtained through ring analysis of 3.0 or less and a sulfur content of 50 ppm by mass or less. The "% $C_A$ obtained through ring analysis" refers to an aromatic content (percentage) calculated through the ring analysis n-d-M method. The sulfur content is measured according to the JIS K 2541.

When the base oil has a % $C_A$ of 3.0 or lower and a sulfur content of 50 ppm by mass or less, the lubricating oil composition employing the base oil exhibits excellent stability against oxidation, and rise in acid value and sludge formation can be suppressed. The % $C_A$ is more preferably 1.0 or lower, still more preferably 0.5 or lower, and the sulfur content is more preferably 30 ppm by mass or less.

The base oil, preferably has a viscosity index of 70 or higher, more preferably 100 or higher, still more preferably 120 or higher. When the base oil has a viscosity index of 70 or higher, variation in viscosity of the base oil is suppressed.

No particular limitation is imposed on the pour point, which is an index for flowability at low temperature, of the base oil. Generally, the pour point is preferably −10° C. or lower.

[Thioheterocyclic Compound]

The thioheterocyclic compound employed in the present invention is represented by the following formula (I).

$$(R^1)_k—(S)_m\text{-}A_S\text{-}(S)_n—(R^2)_l \quad (I)$$

In formula (I), As represents a thioheterocycle; each of $R^1$ and $R^2$ represents a hydrogen atom, an amino group, a C1 to C50 hydrocarbyl group selected from among an alkyl group, a cycloalkyl group, an alkenyl group, a cycloalkenyl group, and an aryl group, or, in the case of a hydrocarbyl group, a C1 to C50 heteroatom-containing group having an atom selected from among an oxygen atom, a nitrogen atom, and a sulfur atom, in the hydrocarbyl group; and each of k, l, m, and n is an integer of 0 to 5.

In formula (I), the case where at least one of m and n is not 0; i.e., the case where one or more sulfur atoms are bonded to at least one side of the thioheterocycle, is preferred, from the viewpoint of enhancement of wear resistance. More preferably, these sulfur atoms are bonded to both sides of the thioheterocycle.

Examples of the thioheterocycle include a benzothiophene ring, a naphthothiophene ring, a dibenzothiophene ring, a thienothiophene ring, a dithienobenzene ring, a thiazole ring, a thiophene ring, a thiazoline ring, a benzothiazole ring, a naphthothiazole ring, an isothiazole ring, a benzoisothiazole ring, a naphthoisothiazole ring, a thiadiazole ring, a phenothiazine ring, a phenoxathiin ring, a dithianaphthalene ring, a thianthrene ring, a thioxanthene ring, and a bithiophene ring. These rings may be substituted.

Among them, a thiadiazole ring is preferably employed, from the viewpoint of enhancement of wear resistance.

The thiadiazole ring is preferably a 1,3,4-thiadiazole ring. The thioheterocyclic compound of the present invention preferably includes a structure in which a sulfur atom is bonded to the 2, and 5-positions of the 1,3,4-thiadiazole ring, from the viewpoint of enhancement of wear resistance.

Furthermore, the thioheterocyclic compound of the present invention more preferably includes a structure in which one sulfur atom is bonded to each of the 2, and 5-positions of the 1,3,4-thiadiazole ring, from the viewpoint of enhancement of wear resistance.

In formula (I), the alkyl group $R^1$ or $R^2$ is preferably a C1 to C30 alkyl group, more preferably a C1 to C24 alkyl group. Specific examples of the alkyl group include n-butyl, isobutyl, sec-butyl, tert-butyl, hexyls, octyls, decyls, dodecyls, tetradecyls, hexadecyls, octadecyls, and icosyls. The alkyl group may be substituted with an aromatic group; such as benzyl or phenethyl.

The cycloalkyl group $R^1$ or $R^2$ is preferably a C3 to C30 cycloalkyl group, more preferably a C3 to C24 cycloalkyl group. Specific examples of the cycloalkyl group include cyclopropyl, cyclopentyl, cyclohexyl, methylcyclopentyl, dimethylcyclopentyl, methylethylcyclopentyl, diethylcyclopentyl, methylcyclohexyl, dimethylcyclohexyl, methylethylcyclohexyl, and diethylcyclohexyl. The cycloalkyl group may be substituted with an aromatic group; such as phenylcyclopentyl or phenylcyclohexyl.

The alkenyl group $R^1$ or $R^2$ is preferably a C2 to C30 alkenyl group, more preferably a C2 to C24 alkenyl group.

Specific examples of the alkenyl group include vinyl, aryl, 1-butenyl, 2-butenyl, 3-butenyl, 1-methylvinyl, 1-methylaryl, 1,1-dimethylaryl, 2-methylaryl, noneyl, decenyl, and octadecenyl. The alkenyl group may be substituted with an aromatic group.

The cycloalkenyl group $R^1$ or $R^2$ is preferably a C3 to C30 cycloalkenyl group, more preferably a C3 to C24 cycloalkenyl group. Specific examples of the cycloalkenyl group include cyclobutenyl and methylcyclobutenyl. The cycloalkenyl group may be substituted with an aromatic group.

The aryl group $R^1$ or $R^2$ is preferably a C6 to C30 aryl group, more preferably a C6 to C24 aryl group. Specific examples of the aryl group include phenyl, tolyl, xylyl, naphthyl, butylphenyl, octylphenyl, and nonylphenyl.

Examples of the thioheterocyclic compound represented by formula (I) include compounds represented by the following formulas.

2-mercapto-5-(2-ethylhexyldithio)-1,3,4-thiadiazole, 2-mercapto-5-(t-nonyldithio)-1,3,4-thiadiazole, 2-(2-ethylhexylamino)thiazole, 2,4-bis(2-ethylhexylamino)thiazole, 2,5-bis(t-nonylamino)-1,3,4-thiadiazole, 2,5-bis(dimethylhexylamino)-1,3,4-thiadiazole, 2,5-bis(octadecenylamino)-1,3,4-thiadiazole, 2,5-bis(methylhexadecenylamino)-1,3,4-thiadiazole, 2-octylaminothiazoline, 2-(2-ethylhexylamino)benzothiazole, 2-(2-ethylhexylamino)thiophene, 2,4-bis(2-ethylhexylamino)thiophene, 2-(2-ethylhexylamino)thiazoline, 2,5-bis(2-hydroxyoctadecylamino)-1,3,4-thiadiazole, 2,5-bis(n-octoxycarbonylmethylamino)-1,3,4-thiadiazole, 2-amino-5-(2-ethylhexylamino)-1,3,4-thiadiazole, 2-amino-5-(t-nonylamino)-1,3,4-thiadiazole, 2-(2-ethylhexyl)thiazole, 2,4-bis(2-ethylhexyl)thiazole, 2,5-bis(t-nonyl)-1,3,4-thiadiazole, 2,5-bis(dimethylhexyl)-1,3,4-thiadiazole, 2,5-bis(octadecenyl)-1,3,4-thiadiazole, 2,5-bis(methylhexadecenyl)-1, (I-a)

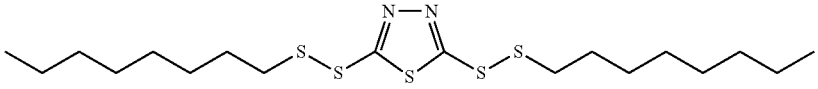

(I-b)

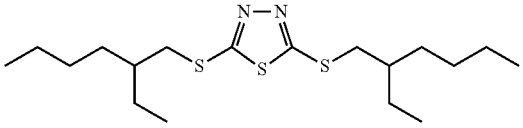

(I-c)

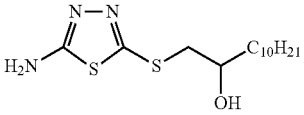

(I-d)

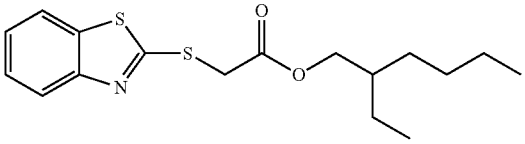

(I-e)

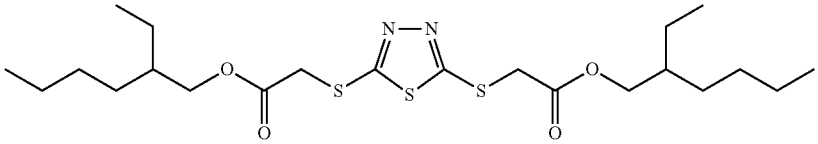

In addition to the above compounds, examples of the thioheterocyclic compound represented by formula (I) include 2-(2-ethylhexylthio)thiazole, 2,4-bis(2-ethylhexylthio)thiazole, 2,5-bis(t-nonylthio)-1,3,4-thiadiazole, 2,5-bis(dimethylhexylthio)-1,3,4-thiadiazole, 2,5-bis(octadecenylthio)-1,3,4-thiadiazole, 2,5-bis(methylhexadecenylthio)-1,3,4-thiadiazole, 2-octylthio-thiazoline, 2-(2-ethylhexylthio)benzothiazole, 2-(2-ethylhexylthio)thiophene, 2,4-bis(2-ethylhexylthio)thiophene, 2-(2-ethylhexylthio)thiazoline, 2,5-bis(2-hydroxyoctadecylthio)-1,3,4-thiadiazole, 2,5-bis(n-octoxycarbonylmethylthio)-1,3,4-thiadiazole, 2-mercapto-5-(2-ethylhexylthio)-1,3,4-thiadiazole, 2-mercapto-5-(t-nonylthio)-1,3,4-thiadiazole, 2-(2-ethylhexyldithio)thiazole, 2,4-bis(2-ethylhexyldithio)thiazole, 2,5-bis(t-nonyldithio)-1,3,4-thiadiazole, 2,5-bis(dimethylhexyldithio)-1,3,4-thiadiazole, 2,5-bis(octadecenyldithio)-1,3,4-thiadiazole, 2,5-bis(methylhexadecenyldithio)-1,3,4-thiadiazole, 2-octyldithio-thiazoline, 2-(2-ethylhexyldithio)benzothiazole, 2-(2-ethylhexyldithio)thiophene, 2,4-bis(2-ethylhexyldithio)thiophene, 2-(2-ethylhexyldithio)thiazoline, 2,5-bis(2-hydroxyoctadecyldithio)-1,3,4-thiadiazole, 2,5-bis(n-octoxycarbonylmethyldithio)-1,3,4-thiadiazole, 3,4-thiadiazole, 2-octyl-thiazoline, 2-(2-ethylhexyl)benzothiazole, 2-(2-ethylhexyl)thiophene, 2,4-bis(2-ethylhexyl)thiophene, 2-(2-ethylhexyl)thiazoline, 2,5-bis(2-hydroxyoctadecyl)-1,3,4-thiadiazole, 2,5-bis(n-octoxycarbonylmethyl)-1,3,4-thiadiazole, 2-(2-ethylhexyl)-1,3,4-thiadiazole, and 2-(t-nonyl)-1,3,4-thiadiazole.

The lubricating oil composition of the present invention has a sulfur content of 0.10 mass % to 1.00 mass % based on the total amount of the composition. When the sulfur content is less than 0.10 mass %, wear resistance is insufficient, whereas when the sulfur content is in excess of 1.00 mass %, corrosion may occur. Thus, the sulfur content is preferably 0.12 mass % 0.90 mass % based on the total amount of the composition, more preferably 0.15 mass % to 0.85 mass %.

The lubricating oil composition of the present invention essentially has a phosphorus content (P mass %) and a sulfated ash content (M mass %), based on the total amount of the composition, satisfying any of the following conditions A to C.

Condition A

Condition A of the present invention is as follows: $P<0.03$, and $M<0.3$. That is, the phosphorus content is essentially less than 0.03 mass %, and the sulfated ash content is essentially less than 0.3 mass %, based on the total amount of the composition.

When the phosphorus content of the composition is less than 0.03 mass %, poisoning of active sites of a three-way catalyst can be suppressed, so that the catalyst service life can be prolonged. Thus, the phosphorus content is preferably 0.02 mass % or less, more preferably 0.01 mass % or less.

Meanwhile, when the sulfated ash content of the composition is less than 0.3 mass %, deposition, on DPF, of an ash component originating from metallic components is suppressed, thereby prolonging the service life. Thus, the sulfated ash content of the composition is preferably 0.2 mass % or less, more preferably 0.1 mass % or less, particularly preferably 0.05 mass % or less.

Condition B

Condition B of the present invention is as follows: $P<0.03$, and $0.3 \leq M \leq 0.6$. That is, the phosphorus content is essentially less than 0.03 mass %, and the sulfated ash content is essentially 0.3 mass % to 0.6 mass %, based on the total amount of the composition.

When the phosphorus content of the composition is less than 0.03 mass %, poisoning of active sites of a three-way catalyst can be suppressed, so that the catalyst service life can be prolonged. Thus, the phosphorus content is preferably 0.02 mass % or less, more preferably 0.01 mass % or less.

Meanwhile, when the sulfated ash content of the composition is 0.3 mass % or more, detergency which is required for a lubricating oil for internal combustion engines can be further enhanced, whereas when the sulfated ash content is 0.6 mass % or less, deposition, on DPF, of an ash component originating from metallic components is suppressed, thereby prolonging the service life. Thus, the sulfated ash content of the composition is preferably 0.3 mass % to 0.5 mass %, more preferably 0.3 mass % to 0.4 mass %.

Condition C

Condition C of the present invention is as follows: $0.03 \leq P \leq 0.06$, and $M<0.3$. That is, the phosphorus content is essentially 0.03 mass % to 0.06 mass %, and the sulfated ash content is essentially less than 0.3 mass %, based on the total amount of the composition.

When the phosphorus content of the composition is 0.03 mass % or more, wear resistance which is required for a lubricating oil for internal combustion engines can be further enhanced, whereas when the phosphorus content is 0.06 mass % or less, poisoning of active sites of a three-way catalyst can be suppressed, so that the catalyst service life can be prolonged. Thus, the phosphorus content is preferably 0.03 mass % to 0.05 mass %, more preferably 0.03 mass % to 0.04 mass %.

Meanwhile, when the sulfated ash content of the composition is less than 0.3 mass %, deposition, on DPF, of an ash component originating from metallic components is suppressed, thereby prolonging the service life. Thus, the sulfated ash content of the composition is preferably 0.2 mass % or less, more preferably 0.1 mass % or less, particularly preferably 0.05 mass % or less.

The phosphorus content of the composition may be tuned by modifying the amount of the phosphorus-containing anti-wear agent. Typical examples of the phosphorus-containing anti-wear agent include phosphate esters and thiophosphate esters. Of these, phosphite esters, alkyl hydrogenphosphite, and phosphate ester amine salts are preferred. In the present invention, zinc dithiophosphate (ZnDTP) is particularly preferred.

[Aminoalcohol Compound]

The aminoalcohol compound has, in the molecule thereof, one or more amino groups and one or more hydroxyl groups. The aminoalcohol compound is prepared by reacting a compound having an epoxy group (hereinafter referred to as "compound (A)") with a compound having at least one of a primary amino group and a secondary amino group (hereinafter referred to as "compound (B)").

<Compound (A)>

Compound (A) preferably has 6 to 40 carbon atoms. When compound (A) has 6 or more carbon atoms, it can be sufficiently dissolved in a lubricating oil base or the like, whereas when compound (A) has 40 or less carbon atoms, it has a high base value. Furthermore, the hydrocarbyl group of compound (A) preferably has 6 to 30 carbon atoms.

In compound (A), the epoxy group is preferably bonded to the hydrocarbyl group. The hydrocarbyl group may be saturated or unsaturated, aliphatic or aromatic, or linear, branched, or cyclic. Examples thereof include an alkyl group and an alkenyl group.

Specific examples of the hydrocarbyl group include hexyl, hexenyl, octyl, octenyl, decyl, decenyl, dodecyl, dodecenyl, tetradecyl, tetradecenyl, hexadecyl, hexadecenyl, octadecyl, octadecenyl, isostearyl, a decene trimer group, and a polybutene group.

Specific examples of compound (A) having an epoxy group include 1,2-epoxyhexane, 1,2-epoxyoctane, 1,2-epoxydecane, 1,2-epoxydodecane, 1,2-epoxytetradecane, 1,2-epoxyhexadecane, 1,2-epoxyoctadecane, 1,2-epoxyeicosane, 1,2-epoxydodecene, 1,2-epoxytetradecene, 1,2-epoxyhexadecene, 1,2-epoxyoctadecene, and 1,2-epoxy-2-octyldodecane.

<Compound (B)>

Preferably, the compound (B) has 1 to 10 nitrogen atoms in total, and 2 to 40 carbon atoms in total. When compound (B) has 10 or less, nitrogen atoms, it can be sufficiently dissolved in a lubricating oil base or the like. When compound (B) has 2 or more carbon atoms, it can be sufficiently dissolved in a lubricating oil base or the like, whereas when compound (B) has 40 or less carbon atoms, it has a high base value. Examples of compound (B) include a primary amine, a secondary amine, and a polyalkylenepolyamine.

The primary amine preferably has a C2 to C40 hydrocarbyl group and may further have an oxygen atom. When the hydrocarbyl group has 2 or more carbon atoms, the primary amine can be sufficiently dissolved in a lubricating oil base or the like, whereas when the hydrocarbyl group has 40 or less carbon atoms, the primary amine has a high base value. The hydrocarbyl group may be saturated or unsaturated, aliphatic or aromatic, or linear, branched, or cyclic. Examples thereof include an alkyl group and an alkenyl group. Specific examples of the hydrocarbyl group include ethyl, butyl, butenyl, hexyl, hexenyl, octyl, octenyl, decyl, decenyl, dodecyl, dodecenyl, tetradecyl, tetradecenyl, hexadecyl, hexadecenyl, octadecyl, octadecenyl, isostearyl, a decene trimer group, and a polybutene group.

Specific examples of the primary amine include ethylamine, butylamine, hexylamine, octylamine, decylamine, dodecylamine, tetradecylamine, hexadecylamine, octadecylamine, 2-ethylhexylamine, 2-decyltetradecylamine, oleylamine, ethanolamine, propanolamine, octadecyloxyethylamine, 3-(2-ethylhexyloxy)propylamine, and 12-hydroxystearylamine.

The secondary amine preferably has 2 to 40 carbon atoms in total in a hydrocarbyl group or hydrocarbyl groups and may further have an oxygen atom. The hydrocarbyl group or groups may be saturated or unsaturated, aliphatic or aromatic, or linear, branched, or cyclic. When the hydrocarbyl group or groups have 2 or more carbon atoms, the secondary amine can be sufficiently dissolved in a lubricating oil base or the like, whereas when the hydrocarbyl group or groups have 40 or less carbon atoms, the secondary amine has a high base value.

Specific examples of the secondary amine include diethylamine, dibutylamine, dihexylamine, dioctylamine, didecylamine, didodecylamine, ditetradecylamine, dihexadecylamine, dioctadecylamine, di2-ethylhexylamine, dioleylamine, methylstearylamine, ethylstearylamine, methyloleylamine, diethanolamine, dipropanolamine, 2-butylaminoethanol, and cyclic secondary amines such as piperidine, piperazine, and morpholine.

The polyalkylenepolyamine has 2 to 10 nitrogen atoms in total, and one of the alkylene groups has 1 to 6 carbon atoms. The polyalkylenepolyamine may further have an oxygen atom. When the total number of the nitrogen atoms is 10 or less, the polyalkylenepolyamine can be sufficiently dissolved in a lubricating oil base or the like, which is preferred. When the alkylene group has 6 or less carbon atoms, sufficient reactivity can be ensured, thereby readily yielding a target product. In this case, detergency at high temperature and consistent base value can be realized, which is also preferred.

Specific examples of the polyalkylenepolyamine include polyalkylenepolyamines such as diethylenetriamine, triethylenetetramine, tetraethylenepentamine, pentaethylenehexamine, dipropylenetriamine, dihexyltriamine, and N-hydroxyethyldiaminopropane; and polyalkylenepolyamines having a cyclic alkyleneamine such as aminoethylpiperazine, 1,4-bisaminopropylpiperazine, and 1-piperazineethanol.

<Ratio of Compound (A) to Compound (B)>

The aminoalcohol compound is preferably a compound prepared through reaction between compound (A) and compound (B) at a ratio by total amount by mole of compound (A) to compound (B) of 0.7:1 to 12:1, more preferably 1:1 to 10:1. When the ratio by total amount by mole of compound (A) to compound (B) is 0.7:1 or higher, the formed aminoalcohol compound exhibits excellent high-temperature detergency, high-temperature stability, and microparticle dispersibility, whereas when the ratio by total amount by mole is 12:1 or lower, the formed aminoalcohol compound has a highly consistent base value. The reaction between compound (A) and compound (B) is preferably carried out at about 50° C. to 250° C., more preferably about 80° C. to 200° C.

<Structure of Aminoalcohol Compound>

The aminoalcohol compound is a reaction product between compound (A) and compound (B) and preferably has a structure represented by the following formula (II):

(II)

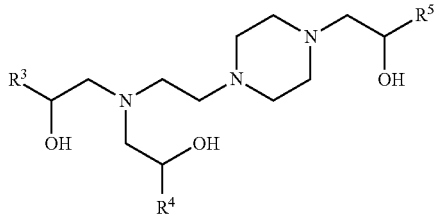

wherein each of $R^3$, $R^4$, and $R^5$ represents a hydrogen atom, an amino group, or a C2 to C38 hydrocarbyl group selected from among an alkyl group, a cycloalkyl group, an alkenyl group, a cycloalkenyl group, and an aryl group.

<Boron Derivative of Aminoalcohol Compound>

The aminoalcohol compound includes a boronated aminoalcohol compound, which is a boron derivative of an aminoalcohol compound. The boronated aminoalcohol compound is prepared through reaction of the aminoalcohol compound with a boron-containing compound. Examples of the boron-containing compound which may be used in the invention include boron oxide, a boron halide, boric acid, boric anhydride, and a borate ester.

The boronated aminoalcohol compound has various advantages, including excellent stability and detergency at high temperature, highly consistent base value, microparticole dispersibility, and low ash content. By virtue of such properties, the lubricating oil composition of the present invention containing the boronated aminoalcohol compound does not cause adverse effects on exhaust gas cleaning apparatuses; e.g., a particulate trap and an oxidation catalyst for oxidizing unburnt fuel and lubricating oil, and is adaptable to coming exhaust gas regulations.

The temperature at which the boronated aminoalcohol compound is reacted is preferably about 50° C. to about 250° C., more preferably about 100° C. to about 200° C. In the reaction, a solvent, for example, an organic solvent such as hydrocarbon oil, may be employed.

The boronated aminoalcohol compound is preferably a compound prepared through reaction between the aminoalcohol compound and the boron-containing compound at a ratio by amount by mole of the aminoalcohol compound and the boron-containing compound of 1:0.01 to 1:10, more preferably 1:0.05 to 1:8.

When the relative amount by mole of the boron compound, with respect to 1 mol of the aminoalcohol compound, is 0.01 or more, the formed boronated aminoalcohol compound exhibits excellent detergency and stability at high temperature. When the relative amount by mole of the boron compound, with respect to 1 mol of the aminoalcohol compound, is 10 or less, problematic solubility of the boronated aminoalcohol compound in the lubricating oil base can be avoided.

The additives for the lubricating oil of the present invention include at least one member selected from among the aminoalcohol compound and the boronated aminoalcohol compound. Such lubricating oil additives are suited for ashless detergent-dispersants.

In the lubricating oil composition of the present invention, the total amount of at least one member selected from among the aminoalcohol compound and the boronated aminoalcohol compound, and other lubricating oil additives is generally adjusted to 0.01 mass % to 50 mass %, preferably 0.1 mass % to 30 mass %.

Also, at least one member selected from among the aminoalcohol compound and the boronated aminoalcohol compound, or other lubricating oil additives may be added to a hydrocarbon oil serving as a fuel oil. In this case, the total amount of the additives is preferably 0.001 mass % to 1 mass %, based on the total amount of the composition.

[Additives]

So long as the effects of the present invention are not impaired, the lubricating oil composition of the present invention may further contain known additives. Examples of such additives include a dispersant, an antioxidant, a metallic detergent, a viscosity index improver, a pour point depressant, a metal deactivator, a rust preventive, and a defoaming agent.

<Dispersant>

In the present invention, a boronated imide-based dispersant and an optional non-boronated imide-based dispersant may be used. The non-boronated imide-based dispersant is generally referred to simply as an imide-based dispersant. The non-boronated imide-based dispersant is preferably a polybutenylsuccinimide. Examples of the polybutenylsuccinimide include compounds represented by the following formulas (1) and (2).

(1)

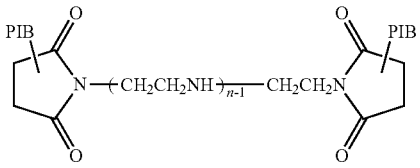

(2)

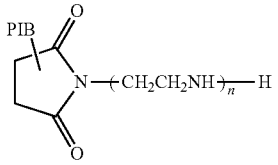

In the above formulas (1) and (2), PIB represents a polybutenyl group generally having a number average molecular weight of 900 to 3,500 preferably 1,000 to 2,000. When the number average molecular weight is 900 or more, satisfactory dispersibility of the resulting composition may be ensured, whereas when the molecular weight is 3,500 or less, satisfactory storage stability of the resulting composition may be ensured.

Also, in the above formulas (1) and (2), n is usually an integer of 1 to 5, preferably 2 to 4.

No particular limitation is imposed on the method for producing the above polybutenylsuccinimide, and any known production method may be employed. For example, polybutene is reacted with maleic anhydride at 100° C. to 200° C., to thereby form a polybutenylsuccinic acid, and the thus-formed polybutenylsuccinic acid is reacted with a polyamine; such as diethylenetriamine, triethylenetetramine, tetraethylenepentamine, and pentaethylenehexamine, to thereby yield a polybutenylsuccinimide.

In the present invention, the boronated imide-based dispersant is preferably a boronated polybutenylsuccinimide prepared by reacting the non-boronated imide-based dispersant represented by formula (1) or (2) with a boron compound.

Examples of the boron compound include a boric acid, a borate salt, and a borate ester. Specific examples of the boric acid include orthoboric acid, metaboric acid, and paraboric acid. Examples of suitable borate salts include ammonium salts; e.g., ammonium borates such as ammonium metaborate, ammonium tetraborate, ammonium pentaborate, and ammonium octaborate. Examples of suitable borate esters include alkyl alcohol (preferably having 1 to 6 carbon atoms) borate esters; e.g., monomethyl borate, dimethyl borate, trimethyl borate, monoethyl borate, diethyl borate, triethyl borate, monopropyl borate, dipropyl borate, tripropyl borate, monobutyl borate, dibutyl borate, and tributyl borate.

Generally, the mass ratio of the boron content B to the nitrogen content N, B/N, of the boronated polybutenylsuccinimide is preferably 0.1 to 3, more preferably 0.2 to 1.

In the lubricating oil composition for internal combustion engines of the present invention, no particular limitation is imposed on the boronated succinimide-based dispersant content and the non-boronated succinimide-based dispersant (imide-based dispersant). Generally, each content is preferably 0.1 mass % to 15 mass %, more preferably 0.5 mass % to 10 mass %. When the dispersant content is 0.1 mass % or more, the resulting composition can exhibit excellent detergency and dispersibility. When the dispersant content is 15 mass % or less, the resulting composition can exhibit an effect of enhancing a detergency and a dispersibility thereof commensurate with the content.

<Antioxidant>

The antioxidant is preferably a phosphorus-free antioxidant. Examples include a phenol-based antioxidant, an amine-based antioxidant, a molybdenum-amine complex-based antioxidant, and a sulfur-based antioxidant.

Examples of the phenol-based antioxidant include 4,4'-methylene bis(2,6-di-t-butyl phenol); 4,4'-bis(2,6-di-t-butyl phenol); 4,4'-bis(2-methyl-6-t-butyl phenol); 2,2'-methylene bis(4-ethyl-6-t-butyl phenol); 2,2'-methylene bis(4-methyl-6-t-butyl phenol); 4,4'-butylidene bis(3-methyl-6-t-butyl phenol); 4,4'-isopropylidene bis(2,6-di-t-butyl phenol); 2,2'-methylene bis(4-methyl-6-nonyl phenol); 2,2'-isobutylidene bis(4,6-dimethyl phenol); 2,2'-methylene bis(4-methyl-6-cyclohexyl phenol); 2,6-di-t-butyl-4-methyl phenol; 2,6-di-t-butyl-4-ethyl phenol; 2,4-dimethyl-6-t-butyl phenol; 2,6-di-t-amyl-p-cresol; 2,6-di-t-butyl-4-(N,N'-dimethylaminomethyl phenol); 4,4'-thiobis(2-methyl-6-t-butyl phenol); 4,4'-thiobis(3-methyl-6-t-butyl phenol); 2,2'-thiobis(4-methyl-6-t-butyl phenol); bis(3-methyl-4-hydroxy-5-t-butyl benzyl)sulfide; bis(3,5-di-t-butyl-4-hydroxybenzyl)sulfide; n-octadecyl-3-(4-hydroxy-3,5-di-t-butylphenyl)propionate; and 2,2'-thio[diethyl-bis-3-(3,5-di-t-butyl-4-hydroxyphenyl)propionate].

Among these phenol-based antioxidants, particularly preferred are bisphenol-based antioxidants and ester group-containing phenol-based antioxidants.

Examples of the amine-based antioxidant include monoalkyldiphenylamine-based antioxidants such as monooctyldiphenyl amine and monononyldiphenylamine; dialkyldiphenylamine-based antioxidants such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine-based antioxidants such as tetrabutyldiphenylamine, tetrahexyldiphenylamine, tetraoctyldiphenylamine and tetranonyldiphenylamine; and α-naphthylamine and phenyl-α-naphthylamine; and alkyl-substituted phenyl-α-naphthylamines such as butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine.

Among them, preferred are dialkyldiphenylamine-based antioxidants and naphthylamine-based antioxidants.

The molybdenum-amine complex-based antioxidant may be a complex formed through reaction of a 6-valent molybdenum compound, specifically, molybdenum trioxide and/or molybdic acid with an amine compound. For example, a compound produced through the production method disclosed in JP 2003-252887A may be used.

No particular limitation is imposed on the amine compound which is reacted with the 6-valent molybdenum compound, and a monoamine, a diamine, a polyamine, and an alkanolamine may be used. Specific examples include alkylamines having a C1 to C30 alkyl group (the alkyl group may be linear or branched), such as methylamine, ethylamine, dimethylamine, diethylamine, methylethylamine, and methylpropylamine; alkenylamines having a C2 to C30 alkenyl group (the alkenyl group may be linear or branched), such as ethenylamine, propenylamine, butenylamine, octenylamine, and oleylamine; alkanolamines having a C1 to C30 alkanol group (the alkanol group may be linear or branched), such as methanolamine, ethanolamine, methanolethanolamine, and methanolpropanolamine; alkylenediamines having a C1 to C30 alkylene group, such as methylenediamine, ethylenediamine, propylenediamine, and butylenediamine; polyamines such as diethylenetriamine, triethylenetetramine, tetraethylenepentamine, and pentaethylenehexamine; compounds formed of any of the monoamines, diamines, and polyamines with a C8 to C20 alkyl group or alkenyl group, such as undecyldiethylamine, undecyldiethanolamine, dodecyldipropanolamine, oleyldiethanolamine, oleylpropylenediamine, and stearyltetraethylenepantamine; heterocyclic compounds such as imidazoline; alkylene oxide adducts or these compounds; and mixtures thereof.

Examples of the molybdenum complex further include succinimide sulfur-containing molybdenum complexes disclosed in JP 3-22438A and JP 2004-2866A. These complex may be produced through the following steps (m) and (n):

(m): a step of reacting an acidic molybdenum compound or a salt thereof with a basic nitrogen compound selected from the group consisting of succinimide, carboxamide, hydrocarbylmonoamine, hydrocarbylpolyamine, a Mannich base, phosphonamide, thiophosphonamide, phosphamide, a dispersant-type viscosity index improver, and a mixture thereof, constantly at about 120° C. or lower, to thereby form a molybdenum complex; and (n) a step of subjecting the product of step (m) to at least one stripping step, or to the stripping step and a sulfurization step, wherein the stripping step and sulfurization step is performed for such a period of time that an isooctane solution of the molybdenum complex having a concentration of 1 g, corresponding to Mo of 0.00025 g exhibits an absorbance less than 0.7 measured by means of a UV-Vis. spectrophotometer with a 1-cm quartz cell at 350 nm, and the reaction mixture is maintained at about 120° C. or lower during the stripping step and sulfurization step.

Alternatively, these molybdenum complexes may be produced through the following steps (o), (p), and (q):

(o) a step of reacting an acidic molybdenum compound or a salt thereof with a basic nitrogen compound selected from the group consisting of succinimide, carboxamide, hydrocarbylmonoamine, hydrocarbylpolyamine, a Mannich base, phosphonamide, thiophosphonamide, phosphamide, a dispersant-type viscosity index improver, and a mixture thereof, constantly at about 120° C. or lower, to thereby form a molybdenum complex;

(p) a step of subjecting the product of step (o) to stripping at about 120° C. or lower; and (q) a step of sulfuring the product of (p) at about 120° C. or lower and a ratio of sulfur and molybdenum of about 1:1 or lower, wherein the sulfurization step is performed for such a period of time that an isooctane solution of the molybdenum complex having a concentration of 1 g, corresponding to Mo of 0.00025 g exhibits an absorbance less than 0.7 measured by means of a UV-Vis. spectrophotometer with a 1-cm quartz cell at 350 nm.

Examples of the sulfur-based antioxidant include phenothiazine, pentaerythritol-tetrakis-(3-laurylthiopropionate), didodecyl sulfide, dioctadecyl sulfide, didodecyl thiodipropionate, dioctadecyl thiodipropionate, dimyristyl thiodipropionate, dodecyloctadecyl thiodipropionate, and 2-mercaptobenzoimidazole.

Among the aforementioned antioxidants, phenol-based antioxidants and amine-based antioxidants are preferred, for the purpose of reducing metallic components and sulfur components. Also, the aforementioned antioxidants may be used singly or in combination of two or more species. From the viewpoint of stability to oxidation, a mixture of one or more phenol-based antioxidant and one or more amine-based antioxidants are preferred.

Generally, the amount of the antioxidant is preferably 0.1 mass % to 5 mass % based on the total amount of composition, more preferably 0.1 mass % to 3 mass %. The amount of the molybdenum complex, as reduced to the molybdenum content, is preferably 10 ppm by mass to 1,000 ppm by mass based on the total amount of the composition, more preferably 30 ppm by mass to 800 ppm by mass, still more preferably 50 ppm by mass to 500 ppm by mass.

<Metallic Detergent>

The metallic detergent may be any of the alkaline earth metallic detergents generally employed in lubricating oils. Examples of the metallic detergent include an alkaline earth metal sulfonate, an alkaline earth metal phenate, an alkaline earth metal salicylate, and a mixture of two or more members of these.

Examples of the alkaline earth metal sulfonate include alkaline earth metal salts of an alkylaromatic sulfonic acid, produced through sulfonization of an alkylaromatic compound having a molecular weight of 300 to 1,500, preferably 400 to 700, particularly magnesium salts and/or calcium salts thereof. Of these, calcium salts are preferably used.

Examples of the alkaline earth metal phenate include alkaline earth metal salts of an alkylphenol, an alkylphenol sulfide, or an alkylphenol Mannich reaction product, particularly magnesium salts and/or calcium salts thereof. Of these, calcium salts are particularly preferably used.

Examples of the alkaline earth metal salicylate include alkaline earth metal salts of an alkylsalicylic acid, particularly magnesium salts and/or calcium salts thereof. Of these, calcium salts are preferably used.

The alkyl group forming the alkaline earth metallic detergent is preferably a C4 to C30 alkyl group, more preferably a C6 to C18 alkyl group. These alkyl groups may be linear or branched. Also, these alkyl groups may be any of a primary alkyl group, a secondary alkyl group, and a tertiary alkyl group.

The alkaline earth metal sulfonate, alkaline earth metal phenate, and alkaline earth metal salicylate include a neutral alkaline earth metal sulfonate, a neutral alkaline earth metal phenate, and a neutral alkaline earth metal salicylate, which are produced by reacting the aforementioned alkylaromatic sulfonic acid, alkylphenol, alkylphenol sulfide, alkylphenol Mannich reaction product, alkylsalicylic acid, or the like directly with an alkaline earth metal oxide or an alkaline earth metal base such as a hydroxide thereof, the alkaline earth metal being magnesium and/or calcium, or transmetallation of an alkali metal salt, the alkali metal being sodium, potassium, or the like, with a corresponding alkaline earth metal salt. Furthermore, the alkaline earth metal sulfonate, phenate, and salicylate also encompass a basic alkaline earth metal sulfonate, a basic alkaline earth metal phenate, and a basic alkaline earth metal salicylate, which are produced by heating the neutral alkaline earth metal sulfonate, neutral alkaline earth metal phenate, and neutral alkaline earth metal salicylate, with an excess amount of an alkaline earth metal salt or an alkaline earth metal base in the presence of water.

Also, the alkaline earth metal sulfonate, phenate, and salicylate further encompass a perbasic alkaline earth metal sulfonate, a perbasic alkaline earth metal phenate, and a perbasic alkaline earth metal salicylate, which are produced by reacting the neutral alkaline earth metal sulfonate, neutral alkaline earth metal phenate, and neutral alkaline earth metal salicylate, with an alkaline earth metal carbonate or borate in the presence of carbonate gas.

In order to reduce sulfur components in the composition, the metallic detergent employed in the present invention is preferably an alkaline earth metal salicylate or an alkaline earth metal phenate. Among them, a perbasic salicylate and a perbasic phenate are preferred, with perbasic calcium salicylate being particularly preferred.

The metallic detergent employed in the present invention preferably has a total base value of 10 mgKOH/g to 500 mgKOH/g, more preferably 15 mgKOH/g to 450 mgKOH/g. These metallic detergent having such a total base value may be used singly or in combination of two or more species.

As used herein, the total base value is a total base value determined through the potentiometric titration method (base value/perchloric acid method) in accordance with JIS K 2501 "Petroleum products and lubricating oils—neutralization value test method" 7.

No particular limitation is imposed on the metal ratio of the metallic detergent employed in the present invention. Generally, one or more metallic detergents having a metal ratio of 20 or less can be used in combination. The metal ratio of the metallic detergent is preferably 3 or less, more preferably 1.5 or less, particularly preferably 1.2 or less, since excellent stability to oxidation, consistent base value, high-temperature detergency, etc. can be attained.

As used herein, the metal ratio of the metallic detergent is represented by valence of metal element×metal element content (mol %)/soap group content (mol %). The metal element refers to calcium, magnesium, etc., and the soap group refers to a sulfonate group, a phenol group, a salicylate group, etc.

The amount of the metallic detergent incorporated into the lubricating oil composition is preferably 0.01 mass % to 20 mass %, more preferably 0.05 mass % to 10 mass %, still more preferably 0.1 mass % to 5 mass %.

When the amount is 0.01 mass % or more, performances such as high-temperature detergency, stability to oxidation, and consistent base value can be readily attained, whereas when the amount is 20 mass % or less, effects commensurate to the amount of addition can be generally attained. Even when the above amount conditions are satisfied, it is important to control the upper limit of the amount of the metallic detergent to as low a level as possible. Through controlling the amount in such a manner, the metallic content; i.e., sulfated ash content, of the lubricating oil composition can be reduced, whereby deterioration of exhaust gas cleaner of automobiles can be prevented.

So long as the aforementioned amount conditions are satisfied, the metallic detergents may be used singly or in combination of two or more species.

Among the aforementioned metallic detergents, perbasic calcium salicylate or perbasic calcium phenate is preferred. Among the aforementioned ashless dispersants, polybutenylsuccinic acid bisimide is particularly preferred. The perbasic calcium salicylate and perbasic calcium phenate preferably has a total base value of 100 mgKOH/g to 500 mgKOH/g, more preferably 200 mgKOH/g to 500 mgKOH/g.

<Viscosity Index Improver>

Examples of the viscosity index improver include polymethacrylate, dispersion-type polymethacrylate, olefin copolymers (e.g., ethylene-propylene copolymer), dispersion-type olefin copolymers, and styrene copolymers (e.g., styrene-diene copolymer and styrene-isoprene copolymer).

For attaining the viscosity index improver, the amount thereof is preferably 0.5 mass % to 15 mass % based on the total amount of the lubricating oil composition, more preferably 1 mass % to 10 mass %.

<Pour Point Depressant>

Examples of the pour point depressant include polymethacrylate having a mass average molecular weight of about 5,000 to about 50,000.

For attaining the pour point depressant, the amount thereof is preferably 0.1 mass % to 2 mass % based on the total amount of the lubricating oil composition, more preferably 0.1 mass % to 1 mass %.

<Metal Deactivator>

Examples of the metal deactivator include benzotriazole compound, a tolyltriazole compound, a thiadiazole compound, and an imidazole compound. The amount of the metal deactivator is preferably 0.01 mass % to 3 mass % based on the total amount of the lubricating oil composition, more preferably 0.01 mass % to 1 mass %.

<Rust Preventive>

Examples of the rust preventive include petroleum sulfonate, alkylbenzene sulfonate, dinonylnaphthalene sulfonate, alkenylsuccinic acid esters, and polyhydric alcohol esters. For attaining the rust preventive, the amount thereof is preferably 0.01 mass % to 1 mass % based on the total amount of the lubricating oil composition, more preferably 0.05 mass % to 0.5 mass %.

<Defoaming Agent>

Examples of the defoaming agent include silicone oil, fluorosilicone oil, and fluoroalkyl ether. From the viewpoints of defoaming effect, cost effectiveness, etc., the amount of defoaming agent is preferably 0.005 mass % to 0.5 mass % based on the total amount of the lubricating oil composition, more preferably 0.01 mass % to 0.2 mass %.

<Other Additives>

The lubricating oil composition of the present invention may further contain a friction modifier, an anti-wear agent, or an extreme pressure agent, in accordance with need. Notably, the friction modifier refers to a compound other than the polar-group-containing compound, which is an essential component of the present invention. The amount of friction modifier is preferably 0.01 mass % to 2 mass % based on the total amount of the lubricating oil composition, more preferably 0.01 mass % to 1 mass %.

Examples of the anti-wear agent or extreme pressure agent include sulfur-containing compounds such as zinc dithiophosphate, zinc phosphate, zinc dithiocarbamate, molybdenum dithiocarbamate, molybdenum dithiophosphate, disulfides, olefin sulfides, sulfidized oils, sulfidized esters, thiocarbonates, thiocarbamates, and polysulfides; phosphorus-containing compounds such as phosphite esters, phosphate esters, phosphonate esters, and amine salts or metal salts thereof; sulfur- and phosphorus-containing anti-wear agents such as thiophosphite esters, thiophosphate esters, thiophosphonate esters, and amine salts or metal salts thereof.

In the case where an anti-wear agent or an extreme pressure agent is incorporated into the lubricating oil composition, the amount thereof must be carefully regulated, so that the phosphorus content or the metal content of the lubricating oil does not excessively increase.

[Properties of Lubricating Oil Composition for Internal Combustion Engines]

The lubricating oil composition of the present invention has the aforementioned compositional proportions and the following properties.

(1) Phosphorus content (JIS-5S-38-92) and sulfated ash content (JIS K2272) satisfy any of the following conditions A to C.

Condition A

Phosphorus content is less than 0.03 mass %, and sulfated ash content is less than 0.3 mass %, based on the total amount of the composition. In this case, the phosphorus content is preferably 0.02 mass % or less, and the sulfated ash content is preferably 0.2 mass % or less.

Condition B

Phosphorus content is less than 0.03 mass %, and sulfated ash content is 0.3 mass % to 0.6 mass %, based on the total amount of the composition. In this case, the phosphorus content is preferably 0.02 mass % or less, and the sulfated ash content is preferably 0.3 mass % to 0.5 mass %.

Condition C

Phosphorus content is 0.03 mass % to 0.06 mass %, and sulfated ash content is less than 0.3 mass %, based on the total amount of the composition. In this case, the phosphorus content is preferably 0.03 mass % to 0.05 mass %, and the sulfated ash content is preferably 0.1 mass % or less.

(2) Sulfur content (JIS K2541) is 0.10 mass % to 1.00 mass %, preferably 0.12 mass % to 0.90 mass %.

The lubricating oil composition of the present invention having the aforementioned characteristics can considerably reduce the high-phosphorus ZnDTP content and the metallic detergent content, while excellent wear resistance and deposition resistance are maintained.

The lubricating oil composition of the present invention can be suitably used as a lubricating oil for internal combustion engines; such as gasoline engines, diesel engines, and gas engines, of two-wheeled vehicles, four-wheeled vehicles, power generation facilities, water vehicles, etc. By virtue of low phosphorus content, low sulfur content, and low sulfated ash content, the lubricating oil composition of the present invention is particularly suitable for internal combustion engines equipped with an exhaust gas cleaner.

EXAMPLES

The present invention will next be described in detail by way of Examples and Comparative Examples, which should not be construed as limiting the invention thereto.

[Methods of Evaluation and Measurement]

Properties and performances of the lubricating oil compositions were determined through the following methods.

<Phosphorus Content>

Determined in accordance with JPI-5S-38-92.

<Sulfur Content>

Determined in accordance with JIS K 2541.

<Boron Content>

Determined in accordance with JPI-5S-38-92.

<Sulfated Ash Content>

Determined in accordance with JIS K 2272.

<Nitrogen Content>

Determined in accordance with JIS K 2609.

<Shell Friction Test Conditions>

Anti-load performance of each of the prepared lubricating oil compositions was assessed by means of a Shell friction tester under the following conditions: load; 294 N, rotation speed; 1,200 rpm, temperature; 80° C., and test time; 30 minutes. The anti-load performance was evaluated as a wear depth (mm) of a test ball.

<Hot Tube Test>

An oil sample and air were continuously fed to a glass tube having an inner diameter of 2 mm, while the tube was maintained at 280° C. The flow rate of the oil sample was adjusted to 0.3 mL/hr, and that of air to 10 mL/min. After the passage of the sample for 16 hours, a lacquer-like deposit on the inner surface of the glass tube was evaluated with reference to a color sample. When the deposit assumed transparent, it was rated as a score of 10, whereas when the deposit assumed black, it was rated as a score of 0. Also, the mass of the lacquer-like deposit on the inner surface was measured. The higher the score, or the smaller the amount of the lacquer-like deposit, the higher the performance of the oil sample.

PRODUCTION EXAMPLES

Production Example 1

Production of Aminoalcohol Compound 1

To a 200-mL separable flask, 41.6 g (155 mmol) of 1,2-epoxyoctadecane, 9.9 g (77.3 mmol) of 1,2-epoxyoctane, and 10.0 g (77.5 mmol) of aminoethylpiperazine (Aep) were fed. The mixture was allowed to react at 130° C. to 140° C. for 2 hours. Subsequently, the reaction mixture was heated to 170° C. and then was further allowed to react for 2 hours. The reaction product was cooled, to thereby yield aminoalcohol compound 1 at a yield of 60.3 g.

Production Example 2

Production of Aminoalcohol Compound 2

Aminoalcohol compound 1 obtained in Production Example 1 was reacted with boric acid, to thereby yield aminoalcohol compound 2. Aminoalcohol compound 2 is a boronated aminoalcohol compound. The total boric acid content of the boronated aminoalcohol compound formed through the reaction was adjusted to <1 mass %, based on the total amount of the aminoalcohol compound.

Production Example 3

Production of Aminoalcohol Compound 3

Aminoalcohol compound 1 obtained in Production Example 1 was reacted with boric acid, to thereby yield aminoalcohol compound 3. The total boric acid content of the boronated aminoalcohol compound formed through the reaction was adjusted to <2 mass %, based on the total amount of the aminoalcohol compound.

Production Example 4

Production of Aminoalcohol Compound 4

To a 200-mL separable flask, 44.7 g (186 mmol) of 1,2-epoxyhexadecane and 8.0 g (62.0 mmol) of aminoethylpiperazine (Aep) were fed. The mixture was allowed to react at 130° C. to 140° C. for 2 hours. Subsequently, the reaction mixture was heated to 170° C. and then was further allowed to react for 2 hours. The reaction product was cooled, to thereby yield aminoalcohol compound 4 at a yield of 52.4 g.

Production Example 5

Production of Aminoalcohol Compound 5

Aminoalcohol compound 4 obtained in Production Example 4 was reacted with boric acid, to thereby yield aminoalcohol compound 5. The total boric acid content of the boronated aminoalcohol compound formed through the reaction was adjusted to <2 mass %, based on the total amount of the aminoalcohol compound.

Examples and Comparative Examples

Examples A1 to A5, and Comparative Examples A1 to A7

A base oil was blended with additives at the compositional proportions shown in Table 1, to thereby prepare lubricating oil compositions for internal combustion engines. Properties and performances of each composition was assessed through the aforementioned methods. Table 1 shows the results.

TABLE 1

| | | Examples | | | | | Comparative Examples | | | | | | |
|---|---|---|---|---|---|---|---|---|---|---|---|---|---|
| | | A1 | A2 | A3 | A4 | A5 | A1 | A2 | A3 | A4 | A5 | A6 | A7 |
| Amount (mass %) | Base oil*1 | bal | bal | bal | bal | bal | bal | bal | bal | bal | bal | bal | bal |
| | Thiadiazole*2 | 0.45 | 0.45 | 0.45 | 0.45 | 0.45 | 0.00 | 0.45 | 0.00 | 0.00 | 0.00 | 0.45 | 0.00 |
| | Amino alcohol 1 | 4.50 | 0.00 | 0.00 | 0.00 | 0.00 | 0.00 | 0.00 | 0.00 | 0.00 | 0.00 | 0.00 | 0.00 |
| | Amino alcohol 2 | 0.00 | 8.00 | 0.00 | 0.00 | 0.00 | 0.00 | 0.00 | 0.00 | 0.00 | 0.00 | 0.00 | 0.00 |
| | Amino alcohol 3 | 0.00 | 0.00 | 8.00 | 0.00 | 0.00 | 0.00 | 0.00 | 8.00 | 0.00 | 8.00 | 0.00 | 8.00 |
| | Amino alcohol 4 | 0.00 | 0.00 | 0.00 | 4.50 | 0.00 | 0.00 | 0.00 | 0.00 | 0.00 | 0.00 | 0.00 | 0.00 |
| | Amino alcohol 5 | 0.00 | 0.00 | 0.00 | 0.00 | 8.00 | 0.00 | 0.00 | 0.00 | 0.00 | 0.00 | 0.00 | 0.00 |
| | ZnDTP*3 | 0.00 | 0.00 | 0.00 | 0.00 | 0.00 | 0.00 | 0.00 | 0.00 | 1.00 | 1.00 | 0.00 | 0.00 |
| | Metallic detergent*4 | 0.00 | 0.00 | 0.00 | 0.00 | 0.00 | 0.00 | 0.00 | 0.00 | 0.00 | 0.00 | 2.00 | 0.00 |
| | Other additives*5 | 23.40 | 23.40 | 23.40 | 23.40 | 23.40 | 23.40 | 23.40 | 23.40 | 23.40 | 23.40 | 23.40 | 23.40 |
| Content (mass %) | N | 0.31 | 0.31 | 0.31 | 0.31 | 0.31 | 0.04 | 0.04 | 0.28 | 0.04 | 0.28 | 0.04 | 0.28 |
| | S | 0.21 | 0.21 | 0.21 | 0.21 | 0.21 | 0.00 | 0.21 | 0.00 | 0.17 | 0.17 | 0.21 | 0.00 |
| | B | 0.00 | 0.08 | 0.16 | 0.00 | 0.16 | 0.00 | 0.00 | 0.16 | 0.00 | 0.16 | 0.00 | 0.16 |
| | P | 0.00 | 0.00 | 0.00 | 0.00 | 0.00 | 0.00 | 0.00 | 0.00 | 0.08 | 0.08 | 0.00 | 0.00 |
| | Sulfated ash | 0.00 | 0.01 | 0.02 | 0.00 | 0.02 | 0.00 | 0.00 | 0.02 | 0.19 | 0.21 | 0.62 | 0.02 |
| Results | Hot tube test (M.R.) | 9.0 | 10.0 | 10.0 | 9.0 | 10.0 | 5.0 | 4.0 | 10.0 | 3.5 | 9.5 | 9.5 | 10.0 |
| | Shell wear (mm) | 0.39 | 0.40 | 0.38 | 0.40 | 0.41 | 0.68 | 0.45 | 0.67 | 0.40 | 0.39 | 0.44 | 0.67 |

Ingredients used for preparing lubricating oil compositions shown in Table 1 are as follows.

1: Base oil: hydro-refined mineral oil (100 N, kinematic viscosity at 40° C.: 21.0 $mm^2/s$, kinematic viscosity at 100° C.: 4.5 $mm^2/s$, viscosity index: 127, and sulfur content: <5 ppm by mass)

2: Thiadiazole (2,5-bis(n-octyldithio)-1,3,4-thiadiazole) having a sulfur content of 33.5 mass % (compound represented by formula (I-a))

3: Zinc dithiophosphate (Zn: 9 mass %, P: 8 mass %, and S: 17.1 mass %, alkyl groups: mixture of sec-butyl and sec-hexyl)

4: Calcium phenate (base value: 300 mgKOH/g)

5: Other additives: Metal deactivator (alkylbenzotriazole), silicone-based defoaming agent, amine-based antioxidant, phenol-based antioxidant, dispersants (including monoimide, bisimide, and boronated monoimide), and viscosity modifiers (OCP and PMA)

As is clear from Table 1, the lubricating oil compositions falling within the scope of the present invention, containing an aminoalcohol compound or a boronated aminoalcohol compound with a thioheterocyclic compound represented by formula (I), exhibited excellent scores and results in the hot tube test and Shell friction test, even when the amounts of phosphorus-containing additives and a metallic detergent were considerably reduced. That is, the lubricating oil composition of the present invention can considerably reduce the amounts of phosphorus-containing additives and a metallic detergent, while high-temperature detergency and wear resistance are maintained.

Examples B1 to B5, and Comparative Examples B1 to B6

A base oil was blended with additives at the compositional proportions shown in Table 2, to thereby prepare lubricating oil compositions for internal combustion engines. Properties and performances of each composition was assessed through the aforementioned methods. Table 2 shows the results.

TABLE 2

| | | Examples | | | | | Comparative Examples | | | | | |
|---|---|---|---|---|---|---|---|---|---|---|---|---|
| | | B1 | B2 | B3 | B4 | B5 | B1 | B2 | B3 | B4 | B5 | B6 |
| Amount (mass %) | Base oil*1 | bal | bal | bal | bal | bal | bal | bal | bal | bal | bal | bal |
| | Thiadiazole*2 | 0.45 | 0.45 | 0.45 | 0.45 | 0.45 | 0.00 | 0.45 | 0.00 | 0.45 | 0.45 | 0.00 |
| | Amino alcohol 1 | 2.30 | 0.00 | 0.00 | 0.00 | 0.00 | 0.00 | 0.00 | 0.00 | 0.00 | 0.00 | 0.00 |
| | Amino alcohol 2 | 0.00 | 4.00 | 0.00 | 0.00 | 0.00 | 0.00 | 0.00 | 0.00 | 0.00 | 0.00 | 0.00 |
| | Amino alcohol 3 | 0.00 | 0.00 | 4.00 | 0.00 | 0.00 | 0.00 | 0.00 | 8.00 | 0.00 | 0.00 | 8.00 |
| | Amino alcohol 4 | 0.00 | 0.00 | 0.00 | 2.30 | 0.00 | 0.00 | 0.00 | 0.00 | 0.00 | 0.00 | 0.00 |
| | Amino alcohol 5 | 0.00 | 0.00 | 0.00 | 0.00 | 4.00 | 0.00 | 0.00 | 0.00 | 0.00 | 0.00 | 0.00 |
| | Metallic detergent*3 | 1.00 | 1.00 | 1.00 | 1.00 | 1.00 | 0.00 | 0.00 | 0.00 | 2.00 | 1.00 | 1.00 |
| | Other additives*4 | 23.40 | 23.40 | 23.40 | 23.40 | 23.40 | 23.40 | 23.40 | 23.40 | 23.40 | 23.40 | 23.40 |

TABLE 2-continued

| | | Examples | | | | | Comparative Examples | | | | | |
|---|---|---|---|---|---|---|---|---|---|---|---|---|
| | | B1 | B2 | B3 | B4 | B5 | B1 | B2 | B3 | B4 | B5 | B6 |
| Content (mass %) | N | 0.19 | 0.19 | 0.19 | 0.19 | 0.19 | 0.04 | 0.04 | 0.28 | 0.04 | 0.04 | 0.28 |
| | S | 0.21 | 0.21 | 0.21 | 0.21 | 0.21 | 0.00 | 0.21 | 0.00 | 0.27 | 0.24 | 0.03 |
| | B | 0.00 | 0.04 | 0.08 | 0.00 | 0.08 | 0.00 | 0.00 | 0.16 | 0.00 | 0.00 | 0.16 |
| | P | 0.00 | 0.00 | 0.00 | 0.00 | 0.00 | 0.00 | 0.00 | 0.00 | 0.00 | 0.00 | 0.00 |
| | Sulfated ash | 0.31 | 0.32 | 0.32 | 0.31 | 0.32 | 0.00 | 0.00 | 0.02 | 0.62 | 0.31 | 0.31 |
| Results | Hot tube test (M.R.) | 9.0 | 9.5 | 10.0 | 9.5 | 10.0 | 5.0 | 4.0 | 10.0 | 9.5 | 8.0 | 10.0 |
| | Shell wear (mm) | 0.39 | 0.40 | 0.42 | 0.40 | 0.41 | 0.68 | 0.45 | 0.67 | 0.44 | 0.46 | 0.65 |

Ingredients used for preparing lubricating oil compositions shown in Table 2 are as follows.

1: Base oil: hydro-refined mineral oil (100 N, kinematic viscosity at 40° C.: 21.0 $mm^2/s$, kinematic viscosity at 100° C.: 4.5 $mm^2/s$, viscosity index: 127, and sulfur content: <5 ppm by mass)

2: Thiadiazole (2,5-bis(n-octyldithio)-1,3,4-thiadiazole) having a sulfur content of 33.5 mass % (compound represented by formula (I-a))

3: Calcium phenate (base value: 300 mgKOH/g)

4: Other additives: Metal deactivator (alkylbenzotriazole), silicone-based defoaming agent, amine-based antioxidant, phenol-based antioxidant, dispersants (including monoimide, bisimide, and boronated monoimide), and viscosity modifiers (OCP and PMA)

As is clear from Table 2, the lubricating oil compositions falling within the scope of the present invention, containing an aminoalcohol compound or a boronated aminoalcohol compound with a thioheterocyclic compound represented by formula (I) exhibited excellent scores and results in the hot tube test and Shell friction test. That is, the lubricating oil compositions of the Examples of the present invention can considerably reduce the amounts of phosphorus-containing additives and a metallic detergent, while high-temperature detergency and wear resistance are maintained.

Examples C1 to C5, and Comparative Examples C1 to C7

A base oil was blended with additives at the compositional proportions shown in Table 3, to thereby prepare lubricating oil compositions for internal combustion engines. Properties and performances of each composition was assessed through the aforementioned methods. Table 3 shows the results.

Ingredients used for preparing lubricating oil compositions shown in Table 3 are as follows.

1: Base oil: hydro-refined mineral oil (100 N, kinematic viscosity at 40° C.: 21.0 $mm^2/s$, kinematic viscosity at 100° C.: 4.5 $mm^2/s$, viscosity index: 127, and sulfur content: <5 ppm by mass)

2: Thiadiazole (2,5-bis(n-octyldithio)-1,3,4-thiadiazole) having a sulfur content of 33.5 mass % (compound represented by formula (I-a))

3: Zinc dithiophosphate (Zn: 9 mass %, P: 8 mass %, and S: 17.1 mass %, alkyl groups: mixture of sec-butyl and sec-hexyl)

4: Other additives: Metal deactivator (alkylbenzotriazole), silicone-based defoaming agent, amine-based antioxidant, phenol-based antioxidant, dispersants (including monoimide, bisimide, and boronated monoimide), and viscosity modifiers (OCP and PMA)

As is clear from Table 3, the lubricating oil compositions falling within the scope of the present invention, containing an aminoalcohol compound or a boronated aminoalcohol compound with a thioheterocyclic compound represented by formula (I) exhibited excellent scores and results in the hot tube test and Shell friction test. That is, the lubricating oil compositions of the Examples of the present invention can considerably reduce the amounts of phosphorus-containing additives and a metallic detergent, while high-temperature detergency and wear resistance are maintained.

The invention claimed is:

1. A lubricating oil composition for internal combustion engines, the lubricating oil composition comprising:

a base oil;

a thioheterocyclic compound represented by the following formula (I):

$$(R^1)_k—(S)_m-A_S-(S)_n—(R^2)_l \quad \text{(I); and}$$

TABLE 3

| | | Examples | | | | | Comparative Examples | | | | | | |
|---|---|---|---|---|---|---|---|---|---|---|---|---|---|
| | | C1 | C2 | C3 | C4 | C5 | C1 | C2 | C3 | C4 | C5 | C6 | C7 |
| Amount (mass %) | Base oil*1 | bal | bal | bal | bal | bal | bal | bal | bal | bal | bal | bal | bal |
| | Thiadiazole*2 | 0.45 | 0.45 | 0.45 | 0.45 | 0.45 | 0.00 | 0.45 | 0.00 | 0.00 | 0.00 | 0.45 | 0.00 |
| | Amino alcohol 1 | 4.50 | 0.00 | 0.00 | 0.00 | 0.00 | 0.00 | 0.00 | 0.00 | 0.00 | 0.00 | 0.00 | 0.00 |
| | Amino alcohol 2 | 0.00 | 8.00 | 0.00 | 0.00 | 0.00 | 0.00 | 0.00 | 0.00 | 0.00 | 0.00 | 0.00 | 0.00 |
| | Amino alcohol 3 | 0.00 | 0.00 | 8.00 | 0.00 | 0.00 | 0.00 | 0.00 | 8.00 | 0.00 | 8.00 | 0.00 | 8.00 |
| | Amino alcohol 4 | 0.00 | 0.00 | 0.00 | 4.50 | 0.00 | 0.00 | 0.00 | 0.00 | 0.00 | 0.00 | 0.00 | 0.00 |
| | Amino alcohol 5 | 0.00 | 0.00 | 0.00 | 0.00 | 8.00 | 0.00 | 0.00 | 0.00 | 0.00 | 0.00 | 0.00 | 0.00 |
| | ZnDTP*3 | 0.50 | 0.50 | 0.50 | 0.50 | 0.50 | 0.00 | 0.00 | 0.00 | 1.00 | 1.00 | 0.50 | 0.50 |
| | Other additives*4 | 23.40 | 23.40 | 23.40 | 23.40 | 23.40 | 23.40 | 23.40 | 23.40 | 23.40 | 23.40 | 23.40 | 23.40 |
| Content (mass %) | N | 0.31 | 0.31 | 0.31 | 0.31 | 0.31 | 0.04 | 0.04 | 0.28 | 0.04 | 0.28 | 0.07 | 0.28 |
| | S | 0.30 | 0.30 | 0.30 | 0.30 | 0.30 | 0.00 | 0.21 | 0.00 | 0.17 | 0.17 | 0.30 | 0.09 |
| | B | 0.00 | 0.08 | 0.16 | 0.00 | 0.16 | 0.00 | 0.00 | 0.16 | 0.00 | 0.16 | 0.00 | 0.16 |
| | P | 0.04 | 0.04 | 0.04 | 0.04 | 0.04 | 0.00 | 0.00 | 0.00 | 0.08 | 0.08 | 0.04 | 0.04 |
| | Sulfated ash | 0.10 | 0.11 | 0.12 | 0.10 | 0.12 | 0.00 | 0.00 | 0.02 | 0.19 | 0.21 | 0.10 | 0.12 |
| Results | Hot tube test (M.R.) | 9.0 | 9.5 | 9.5 | 9.0 | 9.5 | 5.0 | 4.0 | 10.0 | 3.5 | 9.5 | 4.0 | 9.0 |
| | Shell wear (mm) | 0.39 | 0.38 | 0.37 | 0.40 | 0.37 | 0.68 | 0.45 | 0.67 | 0.40 | 0.39 | 0.42 | 0.50 |

an aminoalcohol compound comprising, in the molecule thereof, a piperazine moiety and one or more hydroxyl groups, wherein:

As represents a thioheterocycle;

each of $R^1$ and $R^2$ represents a hydrogen atom, an amino group, a C1 to C50 hydrocarbyl group selected from among an alkyl group, a cycloalkyl group, an alkenyl group, a cycloalkenyl group, and an aryl group, or, in the case of a hydrocarbyl group, a C1 to C50 heteroatom-containing group having an atom selected from among an oxygen atom, a nitrogen atom, and a sulfur atom, in the hydrocarbyl group; and each of k, l, m, and n is an integer of 0 to 5;

the lubricating oil composition has a phosphorus content (P mass %) and a sulfated ash content (M mass %), based on a total mass of the lubricating oil composition, satisfying any of the following conditions A to C:

condition A: $P<0.03$, and $M<0.3$;

condition B: $P<0.03$, and $0.3\leq M\leq 0.6$; and condition C: $0.03\leq P\leq 0.06$, and $M<0.3$.

2. The lubricating oil composition of claim 1, wherein the aminoalcohol compound is a reaction product prepared by reacting a compound having an epoxy group with a piperazine-containing compound having at least one of a primary amino group and a secondary amino group.

3. The lubricating oil composition of claim 1, wherein:

the aminoalcohol compound comprises a compound represented by the following formula (II):

(II)

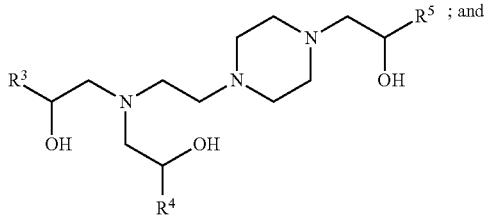

each of $R^3$, $R^4$, and $R^5$ represents a hydrogen atom, an amino group, or a C2 to C38 hydrocarbyl group selected from among an alkyl group, a cycloalkyl group, an alkenyl group, a cycloalkenyl group, and an aryl group.

4. The lubricating oil composition of claim 1, wherein the aminoalcohol compound is a boronated aminoalcohol derivative.

5. The lubricating oil composition of claim 1, wherein the case where both m and n are 0 is excluded.

6. The lubricating oil composition of claim 1, wherein the thioheterocycle is a thiadiazole ring.

7. The lubricating oil composition of claim 6, wherein the thiadiazole ring is a 1,3,4-thiadiazole ring to which a sulfur atom is bonded to the 2-position and the 5-position of the ring.

8. The lubricating oil composition of claim 6, wherein one sulfur atom is bonded to the 2-position or the 5-position of the 1,3,4-thiadiazole ring.

* * * * *